US010352520B2

(12) United States Patent
Komano et al.

(10) Patent No.: US 10,352,520 B2
(45) Date of Patent: Jul. 16, 2019

(54) VEHICLE LIGHTING FIXTURE

(71) Applicant: Stanley Electric Co., Ltd., Tokyo (JP)

(72) Inventors: Kenji Komano, Tokyo (JP); Satoshi Shikata, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/344,388

(22) Filed: Nov. 4, 2016

(65) Prior Publication Data

US 2017/0130921 A1 May 11, 2017

(30) Foreign Application Priority Data

Nov. 11, 2015 (JP) ..... 2015-221382

(51) Int. Cl.
*F21S 41/19* (2018.01)
*F21S 41/20* (2018.01)
(Continued)

(52) U.S. Cl.
CPC ..... *F21S 41/19* (2018.01); *F21S 41/147* (2018.01); *F21S 41/28* (2018.01); *F21S 41/322* (2018.01);
(Continued)

(58) Field of Classification Search
CPC ..... F21S 48/1159; F21S 48/15; F21S 48/10; F21S 48/12; F21S 48/1233;
(Continued)

(56) References Cited

U.S. PATENT DOCUMENTS 6,419,382 B1 * 7/2002 Nakagawa ..... B60Q 1/0005 362/547
2007/0230203 A1 * 10/2007 Ono ..... F21S 48/1394 362/516
2013/0141930 A1 * 6/2013 Inaba ..... B60Q 1/0683 362/516

FOREIGN PATENT DOCUMENTS

DE 10 2004 025 699 A1 1/2005
EP 1 052 449 A2 11/2000
(Continued)

OTHER PUBLICATIONS

Extended European search report for the related European Patent Application No. 16198253.3 dated Apr. 19, 2017.

*Primary Examiner* — Alexander K Garlen
*Assistant Examiner* — Colin J Cattanach
(74) *Attorney, Agent, or Firm* — Kenealy Vaidya LLP

(57) ABSTRACT

A vehicle lighting fixture can effectively utilize an inner space of a lighting chamber defined by a housing and an outer lens for the formation of an optical path, so that the light can be projected through the entire surface region of the outer lens. A reflector can extend forward and obliquely downward and can be arranged below a mounting substrate on which LEDs are mounted. An extension can be arranged in front of an LED substrate holder and the reflector. The extension can have a mirror-finished reflecting rear surface, and include a window hole portion positioned in front of the reflector, a curved portion configured to extend from an upper edge portion of the window hole portion upward and obliquely forward, and an annular flange portion configured to extend from respective outer rim portions of the window hole portion and the curved portion rearward.

8 Claims, 2 Drawing Sheets

(51) Int. Cl.

| | |
|---|---|
| ***F21S 41/30*** | (2018.01) |
| ***F21S 41/32*** | (2018.01) |
| ***F21S 41/33*** | (2018.01) |
| ***F21S 41/36*** | (2018.01) |
| ***F21S 41/50*** | (2018.01) |
| ***F21S 41/141*** | (2018.01) |
| ***F21S 41/147*** | (2018.01) |
| ***F21S 41/148*** | (2018.01) |
| ***F21S 41/365*** | (2018.01) |

(52) U.S. Cl.
CPC ..... *F21S 41/36* (2018.01); *F21S 41/50* (2018.01); *F21S 41/141* (2018.01); *F21S 41/148* (2018.01); *F21S 41/30* (2018.01); *F21S 41/336* (2018.01); *F21S 41/365* (2018.01)

(58) Field of Classification Search
CPC .. F21S 48/1104; F21S 48/1388; F21S 41/147; F21S 41/148; F21S 41/141; F21S 41/19; F21S 41/30; F21S 41/336; F21S 41/36; F21S 41/365; F21S 41/143; F21S 41/255; F21S 41/40; F21S 43/00; F21V 7/00; F21V 7/0008; F21V 7/0025; F21Y 2103/10; F21Y 2105/10; F21Y 2115/10; B60Q 1/0047; B60Q 1/02; B60Q 1/04; B60Q 1/0408; B60Q 1/0416; B60Q 1/0458; B60C 1/0458
See application file for complete search history.

(56) References Cited

FOREIGN PATENT DOCUMENTS

| | | | | | |
|---|---|---|---|---|---|
| EP | 2 071 232 | A1 | | 6/2009 | |
| JP | 2007207527 | A | * | 8/2007 | ..... F21S 41/147 |
| JP | 2012-181979 | A | | 9/2012 | |
| JP | 2013246888 | A | * | 12/2013 | |
| JP | 2013246889 | A | * | 12/2013 | |
| JP | 2014-93285 | A | | 5/2014 | |
| JP | 2014086328 | A | * | 5/2014 | |
| JP | 2014175231 | A | * | 9/2014 | |
| JP | 2015-69860 | A | | 4/2015 | |
| JP | 2015065034 | A | * | 4/2015 | |
| JP | 2015106465 | A | * | 6/2015 | |
| KR | 2013-0011779 | A | | 1/2013 | |
| WO | 2015/044569 | A1 | | 4/2015 | |

* cited by examiner

VEHICLE LIGHTING FIXTURE

This application claims the priority benefit under 35 U.S.C. § 119 of Japanese Patent Application No. 2015-221382 filed on Nov. 11, 2015, which is hereby incorporated in its entirety by reference.

TECHNICAL FIELD

The presently disclosed subject matter relates to a vehicle lighting fixture, and in particular, to a vehicle lighting fixture with an LED serving as a light source.

BACKGROUND ART

Japanese Patent Application Laid-Open No. 2015-069860 discloses examples of conventional vehicle lighting fixtures employing an LED as a light source.

FIG. 1 illustrates an example of this kind of vehicle lighting fixture. As illustrated, the vehicle lighting fixture 80 can include an outer lens 82, a housing 81 that can define a lighting chamber 83 together with the outer lens 82, a substrate 86 on which an LED 85 is mounted, a substrate holder 84 which is fixed to an upper part of the housing 81 and to the lower surface of which the substrate 86 is attached, and a reflector 87 that is disposed below the substrate 86. The LED 85 can be installed so as to face downward to emit light downwardly.

When the LED 85 is turned on to emit light, the reflector 87 below the LED 85 can receive the light to reflect the same forward, to thereby project the light through the outer lens 82 forward of a vehicle body in which the lighting fixture 80 is installed.

In the vehicle lighting fixture 80 with the aforementioned configuration, the vehicle lighting fixture 80 can include an extension 88 with a shielding portion 89 disposed inside and along the outer lens 82 at an upper portion of the lighting fixture 80. This shielding portion 89 of the extension 88 can conceal the substrate holder 84, the substrate 86 with the LED 85 attached, and the like. Furthermore, the extension 88 can have an opening 90 at its lower portion, so that the light emitted from the LED 85 and reflected by the reflector 87 can pass therethrough forward of the vehicle body.

When the vehicle lighting fixture 80 is operated, the inside space of the lighting chamber 83 of the vehicle lighting fixture 80 is not effectively utilized for the purpose of the formation of the light path, and the light can only be projected from the lower region (lower half portion) of the outer lens 82 but not be projected from the upper region (upper half portion) thereof.

Furthermore, since the light is not projected from the entire region of the outer lens 82 but can only be projected from part thereof, an observer may feel a sense of discomfort or strange. Specifically, since the light-exiting area of the outer lens 82 is small and accordingly the cross-sectional area of the projected light is small or the light can be projected not from the entire region but only from the lower half region thereof when viewed from its front side, deterioration of the appearance of the vehicle lighting fixture operated cannot be avoided.

SUMMARY

The presently disclosed subject matter was devised in view of these and other problems and features in association with the conventional art. According to an aspect of the presently disclosed subject matter, a vehicle lighting fixture can effectively utilize an inner space of a lighting chamber defined by a housing and an outer lens for the purpose of formation of an optical path, so that the vehicle lighting fixture can cause the light to be projected through the entire surface region of the outer lens.

According to another aspect of the presently disclosed subject matter, a vehicle lighting fixture can include a housing having an opening; an outer lens configured to form a lighting chamber together with the housing by being attached to the housing so as to close the opening of the housing; a light source configured to include a light emitting device, such as a light emitting diode (LED); a mounting substrate configured to allow the light source to be mounted thereon; a reflector configured to reflect light emitted from the light source; and an extension, wherein the light source (LED), the mounting substrate, the reflector, and the extension can be housed in the lighting chamber, the light source (LED), the reflector, the extension, and the outer lens can constitute an optical system. The vehicle lighting fixture further include a substrate holder arranged in an upper half portion of the lighting chamber, the mounting substrate being attached to the substrate holder to hold the mounting substrate. The reflector can be arranged in a lower half portion of the lighting chamber below the mounting substrate. The extension can be arranged in front of the substrate holder and the reflector, and the outer lens can be positioned in front of the extension. The extension can include a window hole portion positioned in front of the reflector, an upper extension portion configured to extend from an upper edge portion of the window hole portion upward, and an annular flange portion configured to extend from respective outer rim portions of the window hole portion and the upper extension portion rearward. The reflector can be configured to receive the light emitted from the light source (LED) and reflect the light so that the light can pass through the window hole portion and the outer lens to be projected outward. The flange portion of the extension can be configured to receive part of the light emitted from the light source (LED) and reflect the light to the outer lens. The outer lens can be configured to reflect part of the light from the flange portion to the upper extension portion, and the upper extension portion can be configured to reflect the light from the outer lens outward.

In the vehicle lighting fixture with the aforementioned configuration, the extension may further include a mirror-finished reflecting surface on its rear surface.

In the vehicle lighting fixture with the aforementioned configuration, both the housing and the substrate holder can be formed from any one of a resin material and a metal material.

In the vehicle lighting fixture with the aforementioned configuration, the light source may include a plurality of the light emitting diodes that are laterally and linearly mounted on the mounting substrate.

According to the configurations of the presently disclosed subject matter, the lighting chamber can be formed by the housing and the outer lens, and the mounting substrate, the reflector, and the extension can be housed in the lighting chamber to constitute the optical system by the light source (LED), the reflector, the extension, and the outer lens. Specifically, the mounting substrate can be attached to the substrate holder disposed in the upper half portion of the lighting chamber while the reflector can be disposed in the lower half of the lighting chamber below the supporting substrate. Furthermore, the extension can be disposed in front of the substrate holder and the reflector, and the outer lens can be disposed in front of the extension. The extension can include the window hole portion positioned just in front of the reflector, the upper extension portion configured to extend from the upper edge portion of the window hole portion upward, and the annular flange portion configured to extend from the respective outer rim portions of the window hole portion and the upper extension portion rearward.

Therefore, the light emitted from the light source (LED) can be reflected by the reflector to be projected through the window hole portion and the outer lens outward. Furthermore, part of the light emitted from the light source (LED) can be reflected by the flange portion of the extension to pass through the window hole portion and the outer lens to be projected outward. Still further, part of the light can be reflected by the flange portion to be reflected by the outer lens and again reflected by the upper extension portion of the extension so as to be projected through the outer lens outward.

With this configuration, the inside space of the lighting chamber defined by the housing and the outer lens can be effectively utilized for the purpose of formation of an optical path. This configuration enables the light to be projected through the entire region of the outer lens and can improve the appearance of the lighting fixture when turned on during the hours of darkness as well as enhance the value of commodity.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to a vehicle lighting fixture of the presently disclosed subject matter with reference to the accompanying drawings in accordance with exemplary embodiments.

In this description, the directions, i.e., "up (upper)," "down (lower)," "right," "left," "front," and "rear," etc. are defined on the basis of a state wherein the vehicle lighting fixture is mounted in a vehicle body and the light can be irradiated therefrom forward of the vehicle body. For example, a vertical direction is referred to as a height direction of the vehicle body, and a lateral direction (left-right direction) is referred to as a vehicle width direction of the vehicle body.

Figure 1:
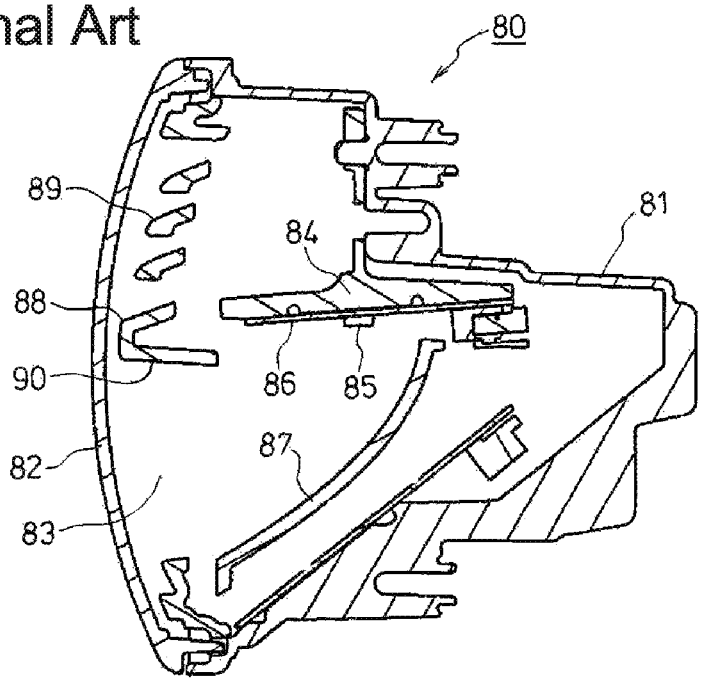
FIG. 1 Conventional Art
FIG. 1 is a cross-sectional view illustrating a conventional vehicle lighting fixture.
Figure 2:
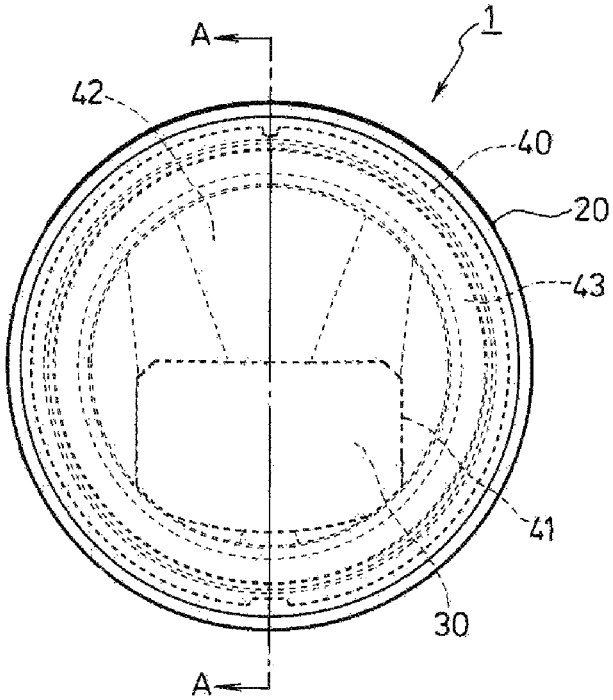
FIG. 2 is a front view illustrating a vehicle lighting fixture made in accordance with principles of the presently disclosed subject matter.
Figure 3:
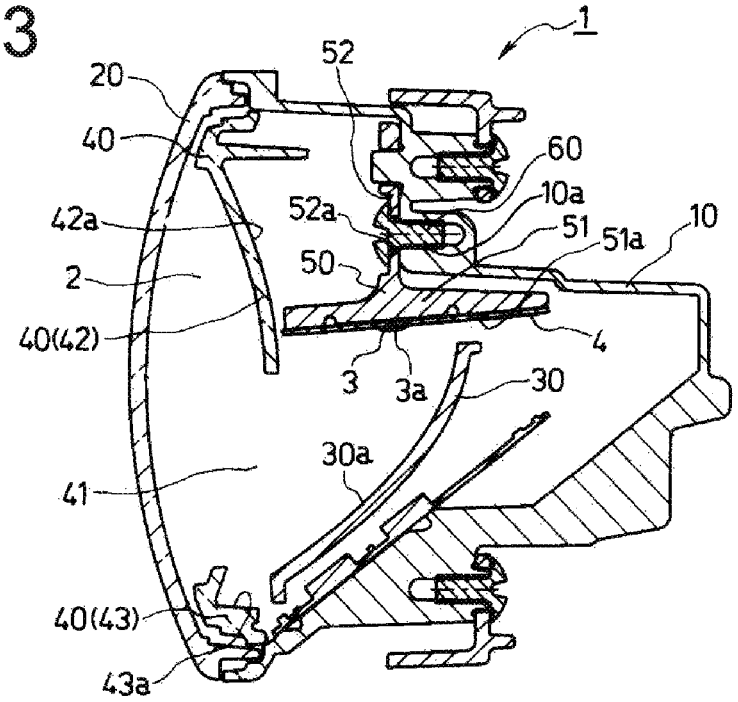
FIG. 3 is a cross-sectional view of the vehicle lighting fixture taken along line A-A in FIG. 2.

FIG. 2 is a front view illustrating a vehicle lighting fixture made in accordance with principles of the presently disclosed subject matter, and FIG. 3 is a cross-sectional view of the vehicle lighting fixture taken along line A-A in FIG. 2.

The vehicle lighting fixture (hereinafter, simply referred to as "lighting fixture") 1 can include a housing 10 having an opening with a bottom at its deeper side, and an outer lens 20 configured to form a lighting chamber 2 together with the housing 10 by being attached to the housing 10 so as to close the opening of the housing 10. The housing 10 can be formed from an opaque resin, for example, and the outer lens 20 can be formed from a transparent resin, for example. The lighting fixture 1 can further include a light source 3 configured to include a light emitting device, such as a light emitting diode 3 (hereinafter, simply referred to as "LED"); a mounting substrate 4 for LED configured to allow the LED 3 to be mounted thereon; a reflector 30 configured to reflect light emitted from the LED 3; and an extension 40. In this configuration, the LED 3, the mounting substrate 4, the reflector 30, and the extension 40 can be housed in the lighting chamber 2. Furthermore, the LED 3, the reflector 30, the extension 40, and the outer lens 20 can constitute an optical system.

The lighting fixture 1 can further include a substrate holder 50 housed in the lighting chamber 2 together with the LED 3, the reflector 30, and the extension 40. The LED mounting substrate 4 with the LED 3 mounted thereon can be attached to the substrate holder 50.

The substrate holder 50 can be formed from a metal material having favorable heat conductivity. Thus, the substrate holder 50 can serve as a heat sink for dissipating heat generated by the LED 3 as well as having the function of holding the LED mounting substrate 4. The substrate holder 50 can include a base portion 51 with a substantially planar shape where the LED mounting substrate 4 is attached, and a support portion 52 with a substantially plate shape extending from the center of one surface of the base portion 51 in a direction perpendicular to the base portion 51. The support portion 52 can have a screw hole 52*a* for use in fixing the substrate holder 50 to the housing 10.

The substrate holder 50 with the aforementioned configuration can be fixed to the housing 10 as follows. First, the plate-shaped support portion 52 can be brought into close contact with the upper portion of the inner surface of the housing at a deeper side (right side in FIG. 3). A screw 60 can be inserted and screwed into the screw hole 52*a* of the support portion 52 and further into a tap hole 10*a* that has been formed in the upper portion of the housing 10 in advance. In this manner, the substrate holder 50 can be fixed in position.

When the substrate holder 50 is fixed to the housing 10, the base portion 51 thereof can be located at a vertical center portion of the lighting chamber 2 while the planar substrate holder 50 can be situated in a horizontal direction. The planar substrate holder 50 can include a flat surface serving as a mounting surface 51*a* for the LED mounting substrate 4 facing downward.

The LED mounting substrate 4 can include a plurality of LEDs 3 (each having an emission surface 3*a*) mounted on the substrate linearly, for example. The LED mounting substrate 4 can be brought into close contact with, and attached to, the mounting surface 51*a* of the base portion 51 of the substrate holder 50 so that the arranged direction of the linearly mounted LEDs 3 is directed laterally (left-right direction) and the emission surfaces 3*a* of the LED 3 face downward.

Below the LED mounting substrate 4 attached to the substrate holder 50, there can be disposed the reflector 30. The reflector 30 can be formed to have a free curved shape extending forward and obliquely downward and open upward. The reflector 30 can include a mirror-finished reflecting surface (hereinafter, simply referred to as "reflecting surface") 30*a* as a recessed inner surface, formed from a metal reflecting film such as an aluminum film or a silver film. The reflector 30 can be disposed so that the reflecting surface 30*a* faces the emission surfaces 3*a* of the LEDs 3 mounted on the LED mounting substrate 4.

The extension 40 can be disposed in front of the reflector 30 and the LED mounting substrate 4 that is attached to the base portion 51 of the substrate holder 50. The extension 40 can include a window hole portion 41 positioned just in front of the reflector 30, a curved portion 42 (or an upper extension portion) configured to extend from an upper edge portion of the window hole portion 41 upward and obliquely forward and be formed from a free curved surface, and an annular flange portion 43 configured to extend from respective outer rim portions of the window hole portion 41 and the curved portion (upper extension portion) 42 rearward.

The extension 40 can be formed from a transparent resin with a mirror-finished reflecting surface on its rear surface. The mirror-finished reflecting surface can be formed by metal deposition, such as aluminum or silver. This configuration can provide a mirror-finished reflecting surface (hereinafter, referred to as "first reflecting surface") 42*a* on the rear surface side (outer surface) of the curved portion (upper extension portion) 42 and another mirror-finished reflecting surface (hereinafter, referred to as "second reflecting surface") 43*a* on the inner surface of the flange portion 43.

In this case, the extension 40 may preferably be subjected to mirror finishing treatment, such as vapor deposition of metal, from its rear surface side. This is because of the following reasons. That is, when the reflecting function is imparted to the extension 40, the extension 40 can be subjected to the mirror finishing treatment from its rear surface side and/or its front surface side. When the mirror finishing treatment is performed only on the front surface side, the flange portion 43 of the extension 40 located on its rear surface side cannot be mirror-finished. On the other hand, when the mirror finishing treatment is performed on both the front and rear surface sides, the curved portion (upper extension portion) 42 and the flange portion 43 of the extension 40 can be mirror-finished simultaneously. However, the mirror-finished rear surface of the curved portion 42 cannot properly function as the reflecting surface due to the mirror-finished front surface thereof. Furthermore, when both the sides are subjected to the mirror-finished treatment, the cost for such treatment may be doubled. Therefore, it is preferable for the extension 40 to have its mirror-finished surface on its rear surface side.

The outer lens 20 can have a curved shape from a free curved surface convex forward, and can be formed from a plain lens without lens cuts on both surfaces.

Figure 4:
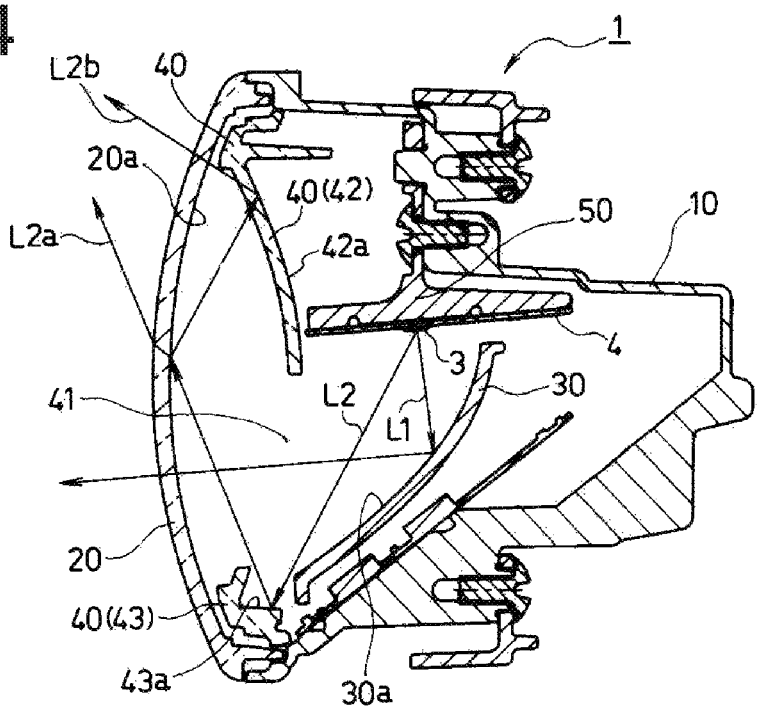
FIG. 4 is a cross-sectional view of the vehicle lighting fixture for illustrating an optical path thereof.

A description will now be given of an optical path of light emitted from the LEDs 3 with reference to FIG. 4, which is an illustration for such an optical path of the vehicle lighting fixture 1 illustrated in FIG. 3.

The LEDs 3 can emit light L1 downward toward the reflector 30 positioned below. The light L1 can be reflected by the reflecting surface 30*a* of the reflector 30 forward to pass through the window hole portion 41 of the extension 40 to reach the outer lens 20. Then, the outer lens 20 can transmit the reflected light L1 to project the same forward.

Furthermore, the LEDs 3 can emit light L2 in a different direction from that of the light L1, i.e., toward the second reflecting surface 43*a*, which is the inner surface of the flange portion 43 of the extension 40 located at a position in a direction extending from the lower end of the reflector 30 (forward and obliquely downward of the lower end of the reflector 30). The light L2 can be reflected by the second reflecting surface 43*a* forward and obliquely upward to reach the outer lens 20 after passing through the window hole portion 41 of the extension 40.

The light reaching the inner surface 20*a* of the outer lens 20 can be impinge thereon at a larger angle with respect to a normal line at that point. Part of the light L2 can pass through the outer lens 20 to be directed forward and obliquely upward as light L2*a*. Remaining part of the light L2 can be reflected off the inner surface 20*a* of the outer lens 20 to be directed rearward and obliquely upward to reach the curved portion (upper extension portion) 42 of the extension 40.

The light reaching the curved portion (upper extension portion) 42 of the extension 40 can be incident on the curved portion 42 to be guided within the curved portion 42 toward the first reflecting surface 42*a* on the rear surface side. The light can be reflected by the first reflecting surface 42*a* to be guided again through the curved portion 42 to exit the same toward the outer lens 20. As a result, the light can pass through the outer lens 20 to be directed forward and obliquely upward as light L2*b*.

Therefore, when the lighting fixture 1 is turned on during the hours of darkness and observed from its front side, the light emitted from the LEDs 3 and reflected by the reflecting surface 30*a* of the reflector 30 can pass through the window hole portion 41 of the extension 40 and then the outer lens 20 to be observed in the lower half portion of the lighting fixture 1. Furthermore, the light emitted from the LEDs 3 and reflected by the second reflecting surface 43*a* of the flange portion 43 of the extension 40 located on the rear surface side of the extension 40 can pass through the window hole portion 41 of the extension 40 and then the outer lens 20 to be observed in the upper half portion of the lighting fixture 1. At the same time, the light that is emitted from the LEDs 3 and reflected by the second reflecting surface 43*a* of the flange portion 43 of the extension 40 and further passes through the window hole 41 of the extension 40 and is reflected by, in this order, the inner surface 20*a* of the outer lens 20 and the first reflecting surface 42*a* of the curved portion (upper extension portion) 42 of the extension 40 can pass the outer lens 20 to be observed in the upper half portion of the lighting fixture 1.

With this configuration, the entire outer lens 20 can be observed to project light entirely. Thus, this configuration can improve the appearance of the lighting fixture 1 when turned on during the hours of darkness as well as enhance the value of commodity.

Further, with reference to FIG. 2, suppose a case where the vehicle lighting fixture 1 is observed from its front side when turned off during daytime. In this case, the first reflecting surface 42*a* of the curved portion (upper extension portion) 42 of the extension 40 can be observed, so that an observer can see the shining reflected light therefrom (metallic appearance) in the upper half portion of the lighting fixture 1. Furthermore, the reflecting surface 30*a* of the reflector 30 can be observed, so that an observer can see the shining reflected light therefrom (metallic appearance) in the lower half portion of the lighting fixture 1.

This means that the shining reflected light can be observed over the entire surface of the outer lens 20, resulting in enhanced the value of commodity with the improved aesthetic appearance of the lighting fixture 1 when turned off during daytime.

The curved portion (upper extension portion) 42 of the extension 40 can also have a function of concealing the components therebehind, such as the housing 10 positioned on the rear side, the substrate holder 50 to which the LED mounting substrate 4 is attached, and the like components. This concealing can also enhance the aesthetic appearance of the vehicle lighting fixture 1.

Although the housing 10 is formed from a resin material, it is not limitative and the housing 10 may be formed from other materials, such as a metal material, by, for example, aluminum die-casting. In this case, it is preferable to improve the heat transfer performance of the housing 10 in which the heat generated from the turned-on LEDs 3 can be transferred through the substrate holder 50 to the housing 10 and dissipated from the housing 10 into surrounding air. With this configuration, the generated heat from the LEDs 3 can be efficiently dissipated to suppress the excess heat increase of the LEDs 3 through the meal-made housing 10. Thus, the deterioration of the emission efficiency of the LEDs 3 due to the self-heating of the LEDs 3 can be prevented to suppress the decrease in the amount of emitted light. At the same time, the degradation of the element of the LEDs 3 due to the self-heating of the LEDs 3 can be prevented to suppress the shortening of the life of the LEDs 3. As a result, higher reliability and appropriate amount of irradiated light can be ensured.

The vehicle lighting fixture 1 with the aforementioned configuration can be used, for example, as a fog lamp or the like vehicle lamp. The vehicle lighting fixture 1 can form a light distribution pattern including a main light distribution pattern that can satisfy a light distribution standard and a subsidiary light distribution pattern that can enhance the feeling of turning-on the lighting fixture or the aesthetic appearance of the lighting fixture both during turning-on and also turning-off, in which the main light distribution pattern can be formed by the light L1 reflected by the reflector 30 to be projected forward, and the subsidiary light distribution pattern can be formed by the light L2*a* and L2*b* reflected by the extension 40 to be projected forward and obliquely upward, and also in which the curved portion (upper extension portion) of the extension in the upper half portion and the reflecting surface of the reflector in the lower half portion can be observed entirely when viewed from its front side.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting fixture comprising:

a housing having an opening;

an outer lens configured to form a lighting chamber together with the housing by being attached to the housing so as to close the opening of the housing;

a light source configured to include a light emitting device;

a mounting substrate configured to allow the light source to be mounted thereon;

a reflector configured to reflect light emitted from the light source; and an extension, wherein:

the light source, the mounting substrate, the reflector, and the extension are housed in the lighting chamber;

the light source, the reflector, the extension, and the outer lens constitute an optical system;

the vehicle lighting fixture further comprises a substrate holder arranged in an upper half portion of the lighting chamber, the mounting substrate being attached to the substrate holder to hold the mounting substrate;

the reflector is arranged in a lower half portion of the lighting chamber below the mounting substrate;

the extension is arranged in front of the substrate holder and the reflector;

the outer lens is positioned in front of the extension;

the extension includes a window hole portion positioned in front of the reflector, an upper extension portion configured to extend from an upper edge portion of the window hole portion upward and obliquely forward and formed from a free curved surface, and an annular flange portion configured to extend from respective outer rim portions of the window hole portion and the upper extension portion rearward;

the extension includes a mirror-finished surface on a rear surface thereof so as to provide a first reflecting surface on a rear surface side of the upper extension portion and a second reflecting surface on an inner surface of the annular flange portion, the reflector is configured to receive the light emitted from the light source and reflect the light so that the light can pass through the window hole portion and the outer lens to be projected outward;

the flange portion of the extension includes a front upward extending portion located at a front of the second reflecting surface that, together with the upper extension portion of the extension, define the window hole to block a portion of light that is reflected by the second reflecting surface towards the outer lens, and the flange portion of the extension is configured to receive part of the light emitted from the light source and reflect the light to the outer lens by means of the second reflecting surface;

the outer lens has a curved shape from a free curved surface convex forward and is formed from a plain lens without lens cuts on both surfaces so as to reflect part of the light from the flange portion to the upper extension portion; and the upper extension portion is configured to reflect the light from the outer lens outward by means of the first reflecting surface.

2. The vehicle lighting fixture according to claim 1, wherein both the housing and the substrate holder are formed from a metal material.

3. The vehicle lighting fixture according to claim 1, wherein the light source includes a plurality of light emitting diodes that are laterally and linearly mounted on the mounting substrate.

4. The vehicle lighting fixture according to claim 2, wherein the light source includes a plurality of light emitting diodes that are laterally and linearly mounted on the mounting substrate.

5. The vehicle lighting fixture according to claim 1, wherein the extension is formed from a transparent resin with the mirror-finished surface formed on the rear surface thereof.

6. The vehicle lighting fixture according to claim 2, wherein the extension is formed from a transparent resin with the mirror-finished surface formed on the rear surface thereof.

7. The vehicle lighting fixture according to claim 3, wherein the extension is formed from a transparent resin with the mirror-finished surface formed on the rear surface thereof.

8. The vehicle lighting fixture according to claim 4, wherein the extension is formed from a transparent resin with the mirror-finished surface formed on the rear surface thereof.

* * * * *